United States Patent [19]

Rollins et al.

[11] Patent Number: 4,579,143

[45] Date of Patent: Apr. 1, 1986

[54] CONTROL AND PURGE VALVE FOR ATOMIZATION OF HEAVY FUEL OIL FOR COMBUSTION

[75] Inventors: Marvin J. Rollins; William P. Coppin, both of Muncie, Ind.

[73] Assignee: Maxon Corporation, Muncie, Ind.

[21] Appl. No.: 599,710

[22] Filed: Apr. 12, 1984

Related U.S. Application Data

[63] Continuation-in-part of Ser. No. 410,437, Aug. 23, 1982, abandoned.

[51] Int. Cl.[4] ..... F16K 11/06

[52] U.S. Cl. ..... 137/625.48; 137/597; 137/238; 251/206; 251/327

[58] Field of Search ..... 137/625.48, 625.5, 625.25, 137/625.27, 625.29, 625.12, 625.13, 597, 237, 238, 625.11, 625.14, 625.17, 625.18, 115, 116, 494; 431/3, 29, 121; 251/326; 91/167; 92/62

[56] References Cited

U.S. PATENT DOCUMENTS

| | | | |
|---|---|---|---|
| 1,775,856 | 9/1930 | Hauser | 137/625.25 X |
| 2,045,823 | 6/1936 | Barrow | 137/625.48 X |
| 2,098,119 | 11/1937 | White | 137/115 |
| 2,473,687 | 6/1949 | Kershaw | 91/167 |
| 2,702,007 | 2/1955 | Skinner | 91/167 X |
| 2,831,464 | 4/1958 | Lillquist | 91/167 |
| 2,858,851 | 11/1958 | Holl | 137/625.48 |
| 3,776,276 | 12/1973 | Stiltner | 137/625.48 X |
| 3,933,165 | 1/1976 | Budzak et al. | 137/625.48 |
| 3,939,871 | 2/1976 | Dickson | 137/625.47 |
| 4,146,056 | 3/1979 | Buchanan | 137/597 |
| 4,191,214 | 3/1980 | Holley et al. | 137/630.2 |
| 4,454,892 | 6/1984 | Chadshay | 137/597 |

FOREIGN PATENT DOCUMENTS

| | | | |
|---|---|---|---|
| 2425371 | 12/1975 | Fed. Rep. of Germany | 92/62 |

OTHER PUBLICATIONS

Pippenger & Koff, "Fluid-Power Controls", McGraw Hill, New York, 1959, p. 15.

*Primary Examiner*—Martin P. Schwadron
*Assistant Examiner*—John S. Starsiak, Jr.
*Attorney, Agent, or Firm*—Robert M. Ward

[57] ABSTRACT

The improved control and purge valve of the present invention is useful for the atomization of heavy fuel oil for combustion. The present control and purge valve is operable between closed, purging, and open positions, and includes an elongated valve body having a disc carrier disposed therein. The disc carrier preferably comprises a plurality of closure and orifice means thereon for opening or closing internally disposed steam exit, steam bypass exit, and oil exit ports to effect the closed, purging, and open positions of the valve of the present invention.

23 Claims, 6 Drawing Figures

CONTROL AND PURGE VALVE FOR ATOMIZATION OF HEAVY FUEL OIL FOR COMBUSTION

BACKGROUND OF THE PRESENT INVENTION

This is a continuation-in-part of application Ser. No. 410,437, filed on Aug. 23, 1982, now abandoned.

The present invention relates generally to valves, and is directed in particular to an improved control and purge valve for atomization of heavy fuel oil for combustion.

In the prior art, several valves have been proposed for atomizing fuel oil of the kind used in large industrial burners. Such prior art valves have recognized the necessity of purging the fuel oil lines prior to closing the valve. Steam has been recognized as a convenient agent for such atomization and for purging purposes.

However, such prior art valves have had a number of disadvantages and deficiencies associated therewith. Some valves have utilized structures which required valve bodies having complicated shapes and with channels cut therein at acute angles, which has added to the expenses of production of the valve body, and which has rendered the accuracy and efficiency of the resulting valve to be less than optimal. Also, such complex valve core means, which in some cases have required machining to extremely accurate tolerances, inter alia. Also, plunger systems have been utilized as a part of such valve cores, which being lacking in one piece structure, have caused problems in operation and alignment, and difficulty and increased expense in servicing, as well as an increased initial cost in producing such valve cores.

Accordingly, in view of the deficiencies of such prior art valves, it is a material object of the improved control and purge valve for automization of heavy fuel oil for combustion of the present invention to alleviate, diminish, and/or eliminate the debilitating features and objections of prior art devices.

SUMMARY OF THE INVENTION

The improved control and purge valve of the present invention is useful in the atomization of heavy fuel oil for combustion. The valve is operable between closed, purging, and open positions, and comprises an elongated valve body having a central bore therein. The central bore contains a valve disc carrier which includes closure and orifice means thereon and is slidable longitudinally within the valve bore for operation between the closed, purging, and open positions.

The valve body includes externally opening steam inlet and steam outlet means, and externally opening oil inlet and oil and steam purge outlet means. Internally disposed within the valve body are steam entry and exit ports. Each of the entry ports includes a preferably spring loaded valve follower disposed adjacent thereon and on one side of the valve disc carrier, and each of the exit ports includes a seat ring disposed adjacent thereto and on the opposite side of the valve disc carrier. Both the valve seats and the follower rings are preferably sealed by means of O-rings to prevent leakage within the interior of and exterior of the valve.

The valve actuating means preferably comprises a two-stage tandem fluidic cylinder controlled by a pair of four-way solenoid valves for disposing the valve of the present invention into the closed, purging, and open positions. A spring return is preferably included within the tandem fluidic cylinder, such that if pressure is lost to the fluidic cylinder, the valve of the present invention will return automatically to the closed position.

Accordingly, the improved control and purge valve of the present invention is of considerably reduced complexity as compared to prior art valves. Hence, the initial production costs are lowered, and service is made less expensive as the valve is more dependable and easier to service.

DETAILED DESCRIPTION OF PREFERRED EMBODIMENTS

Figure 1:
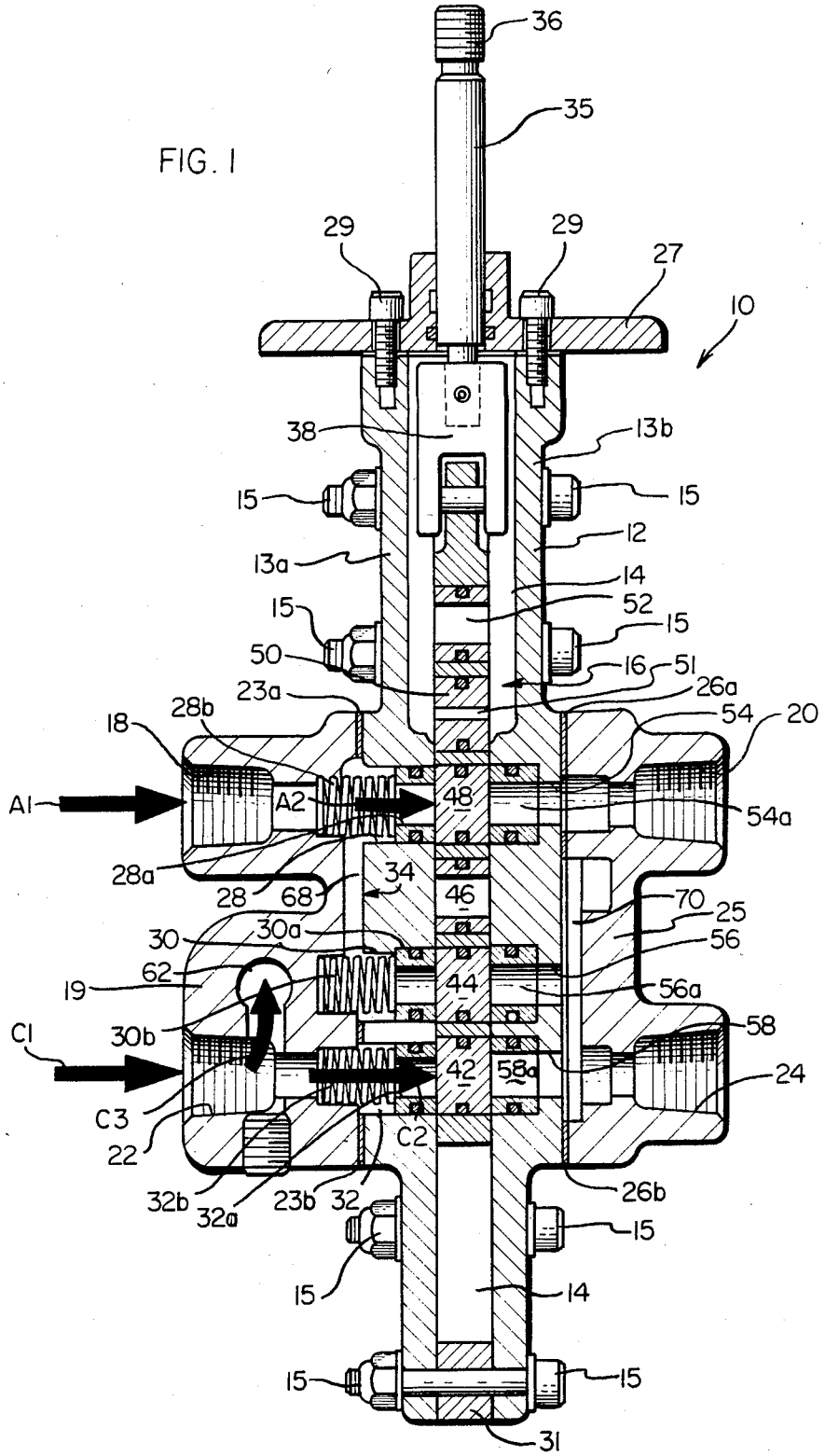
FIG. 1 is a longitudinal cross-sectional view of the improved control and purge valve of the present invention showing the valve in closed position, and further showing in vertically downward array closure discs carried by the valve disc carrier occluding each of the steam exit port, and oil exit port, and further showing the oil entering the oil bypass means due to the buildup of pressure within the oil bypass means chamber caused by the closing of the valve.

The improved control and purge valve of the present invention is of the kind useful for atomizing heavy fuel oil prior to combustion thereof and in burners such as industrial heating burners. The improved control and purged valve of the present invention is selectively operable between closed, purging, and open positions.

The improved control and purge valve of the present invention comprises an elongated valve body having a longitudinally disposed central bore therein for containing valve disc carrier means. Externally opening from the valve body are steam inlet and steam outlet means which are preferably disposed on opposite sides of the valve body at the same height for uniformity and convenience of production. Also, externally opening from the valve body are oil inlet and oil and steam purge outlet means, which are also preferably oppositely disposed on the valve body, and which are preferably disposed at the same height thereon.

The valve body further has an internally disposed steam entry port, an internally disposed steam bypass entry port and an internally disposed oil entry port. These ports are preferably disposed perpendicularly of, and open into the central bore of the valve body. A selectively operative purge means connects the steam inlet means and the oil and means purge outlet means, preferably through the steam bypass entry port for purging the oil and steam purge outlet means when the valve is in the purging position.

The valve disc carrier means is disposed within the central bore of the valve body and operates between the closed, purging, and open positions. The valve disc carrier means includes respective closure and orifice means thereon. The closure and orifice means operate to close each of the steam entry, steam bypass entry, and oil entry ports (when in the closed position), to open at least the steam bypass port and close the oil entry port (when in the purging position), and open the steam entry and oil entry ports and close the steam bypass entry port (when in the open position).

Valve actuating means are provided for selective longitudinal movement of the valve stem within the valve central bore to effect thereby the closed, purging, and open positions of the valve. The closed, purging, and open positions of the valve are thus effected by successive sliding extension of the valve disc carrier within the valve central bore.

The valve disc carrier means comprises a preferably unitary, elongated disc carrier wich contains a plurality of closure and orifice discs thereon. The closure and orifice discs preferably comprise, in sequential array from the distal to the proximal end of the disc carrier:

(a) a first closure disc for closing said oil entry port when in the closed position;
(b) a second closure disc for closing said steam bypass entry port when in the closed position and for closing said oil entry port when in the purging position;
(c) a first orifice disc for opening said steam bypass entry port when in the purging position and for opening said oil entry port when in the open position;
(d) a third closure disc for closing said steam entry port when in the closed position and for closing said steam bypass entry port when in the open position;
(e) a fourth closure disc for closing said steam entry port when in the purging position; and
(f) a second orifice disc for opening said steam entry port when in the open position.

In preferred embodiments, each of the steam entry port, the steam bypass entry port, and the oil entry port contains a valve follower having a valve follower aperture therein. The respective valve followers are engaged by springs to urge the valve seats into snug and operative engagement with the respective closure and orifice means on the valve disc carrier. In preferred embodiments, the valve body further includes a steam exit port, a steam bypass exit port and an oil exit port, each of which is respectively disposed respectively opposite the steam entry port, the steam bypass entry port, and the oil entry port for simplicity and ease of manufacture. In such embodiments, the steam exit port communicates with the steam outlet means, and the steam bypass exit port and the oil exit port communicate with the oil and steam purge outlet means. Also in such preferred embodiments, the steam exit port communicates directly with the steam outlet means, and the oil exit port communicates directly with the oil and steam purge outlet means, preferably in straight line communication therewith.

Also in preferred embodiments, seat rings are disposed within each of the steam exit port, the steam bypass exit port, and the oil exit port for engagement with the side of the closure and orifice means of the valve disc carrier that is opposite the steam entry port, the steam bypass entry port, and the oil entry port.

Each of the valve seats, the closure and orifice discs, and the follower rings is preferably sealed with an O-ring to prevent leakage.

In other preferred embodiments, oil bypass means is provided for recirculating the oil to an oil supply when the valve of the present invention is in either of the closed or the purging positions. Such oil bypass means communicate with the oil inlet means, and comprise a chamber having a relief plunger disposed therein. The relief plunger has a compression spring engaged therewith and disposed to urge the relief plunger into closed disposition. The pressure of the compression spring is less than the oil pressure when the oil entry port is closed by the closure and orifice means. Thus, when the valve is in the closed or purging position, the oil pressure within the oil bypass means chamber is sufficient to push the relief plunger away from its seated position and thereby to recirculate the oil to the supply thereof.

In other preferred embodiments of the improved control and purge valve of the present invention the valve actuating means comprises a two-stage tandem fluidic cylinder. Each of the stages of the cylinder extends in response to a separate four-way solenoid valve to move the improved valve of the present invention from the closed, to the purging, and finally to the open position. A return spring is preferably disposed inside the tandem cylinder for retracting the valve of the present invention from the open, to the purging, and finally to the closed position. Thus, the valve of the present invention is automatically urged to the closed position in the event of a failure of pressure to the fluidic cylinder.

The selectively operable purge means of the present invention has a first purge chamber disposed externally of the valve body and longitudinally therein connecting the steam entry port with the steam bypass entry port. A second purge chamber is also disposed externally of the valve body and longitudinally therein and oppositely disposed within the valve body from the first purge chamber. The second purge chamber communicates the bypass entry port with the oil and steam purge outlet means when the valve is in the purging position.

Figure 2:
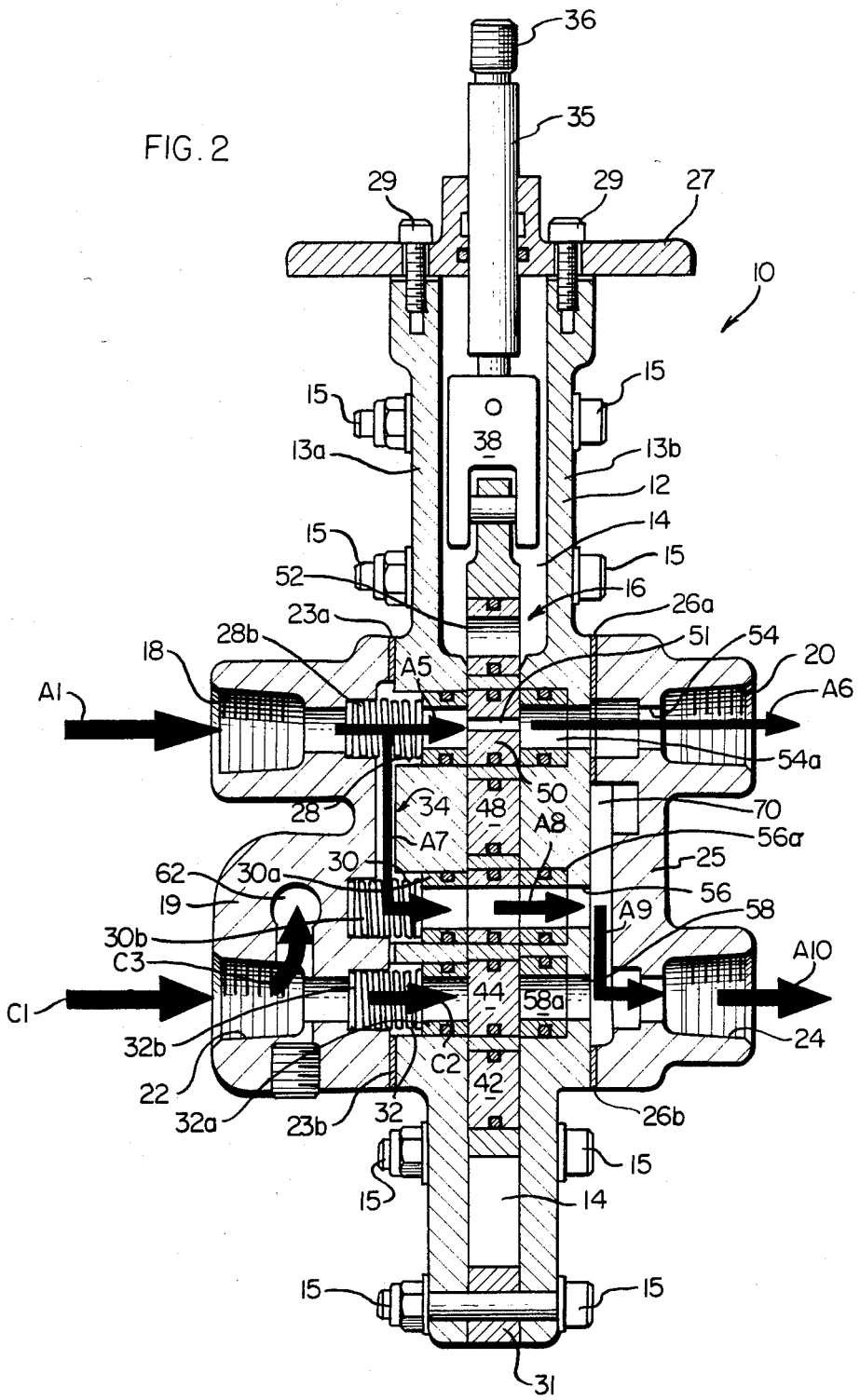
FIG. 2 is a longitudinal cross-sectional view showing the improved control and purge valve of the present invention in the steam bypass or purging position, with the steam exit port receiving a small flow of steam therethrough by means of an orifice having an operture therein of reduced diameter, the steam bypass exit port being rendered open by means of an orifice disc, and the oil exit port being occluded by a closure disc, and also showing as in FIG. 1 the oil exiting to the oil bypass means, and further showing steam exiting the valve of the present invention from the externally opening oil and steam purge outlet means.
Figure 3:
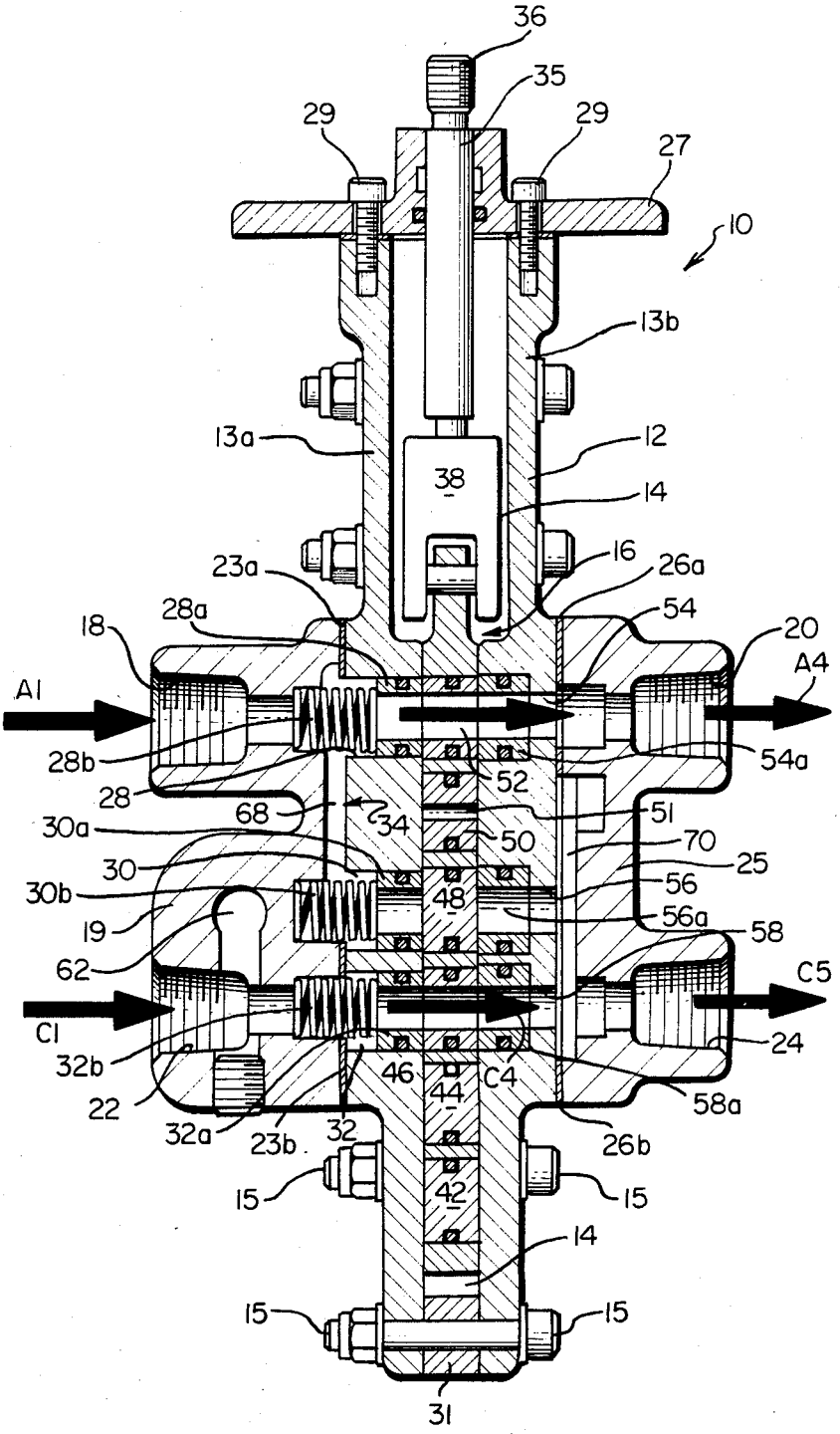
FIG. 3 is a longitudinal cross-sectional view of the improved control and purge valve of the present invention shown in open position, with atomizing steam exiting from the steam outlet means, the oil exiting from the oil and steam purge outlet means, and also showing therebetween the steam bypass port occluded by a disc carried by the valve disc carrier, and the oil bypass rendered inoperative because of free-flow of the fuel oil through the valve of the present invention which reduces the pressure on the oil bypass means chamber.

Referring now to the drawing, wherein common reference numerals are used to denote the common elements, the improved control and purge valve of the present invention 10 is selectively operable between the closed position as shown in FIG. 1, the purging position as shown in FIG. 2 and the open position as shown in FIG. 3.

The improved control and purge valve of the present invention 10 comprises an elongated valve body 12 having a longitudinally disposed central bore 14 therein for containing valve disc carrier means generally 16. Valve body 12 may comprise relatively broader side plates 13*a*, 13*b* secured to relatively narrower front and back plates (not shown in cross-sectional views) by means of bolts 15. Although central bore 14 may be of various diverse configurations, the preferred shape is one which is relatively smaller in the transverse dimension and relatively greater in the dimension within the plane of the paper as shown in FIGS. 1, 2 and 3. Central bore 14 is further defined by valve bonnet 27 at the top of valve 10 secured to side plates 13*a*, 13*b* and the front and back plates by bolts 29. Valve bottom 31 is disposed at the bottom of central bore 14.

A steam inlet means 18 and steam outlet means 20 are preferably disposed on opposite sides of valve body 12 at the same height for uniformity and convenience of production. Oil inlet means 22 and oil and steam purge outlet means 24 are also oppositely disposed on valve body 12 and are disposed preferably at the same height thereon.

Steam inlet means 18 and oil inlet means 22 may be preferably formed as a unitary means 19 from a single piece of material, and attached to valve body 12 by bolts 21 as shown in FIG. 1. A seal 23*a*, 23*b* is provided at the perimeter of unitary inlet means 19 for sealing the same with respect to valve body 12. Likewise, steam outlet means 20 and oil and steam purge outlet means 24 may be preferably formed as a unitary outlet means 25 being sealed with a perimeter seal 26*a*, 26*b*.

Valve body 12 further has an internally disposed steam entry port 28, an internally disposed steam bypass entry port 30, and an internally disposed oil entry port 32. These entry ports 28, 30, 32 are disposed transversely of, and preferably perpendicularly of, and open into central bore 14 of valve body 12 as shown in FIGS. 1, 2 and 3. A selectively operative purge means generally 34 connects steam inlet means 18 and oil and steam purge outlet means 24 through steam bypass entry port 30 for purging oil and steam purge outlet means 24 when valve 10 is in the purging position as shown in FIG. 2.

Valve disc carrier means 16 is disposed within central bore 14 of valve body 12 and operates between the closed, purging, and open positions of FIGS. 1, 2 and 3 respectively.

Figure 5:
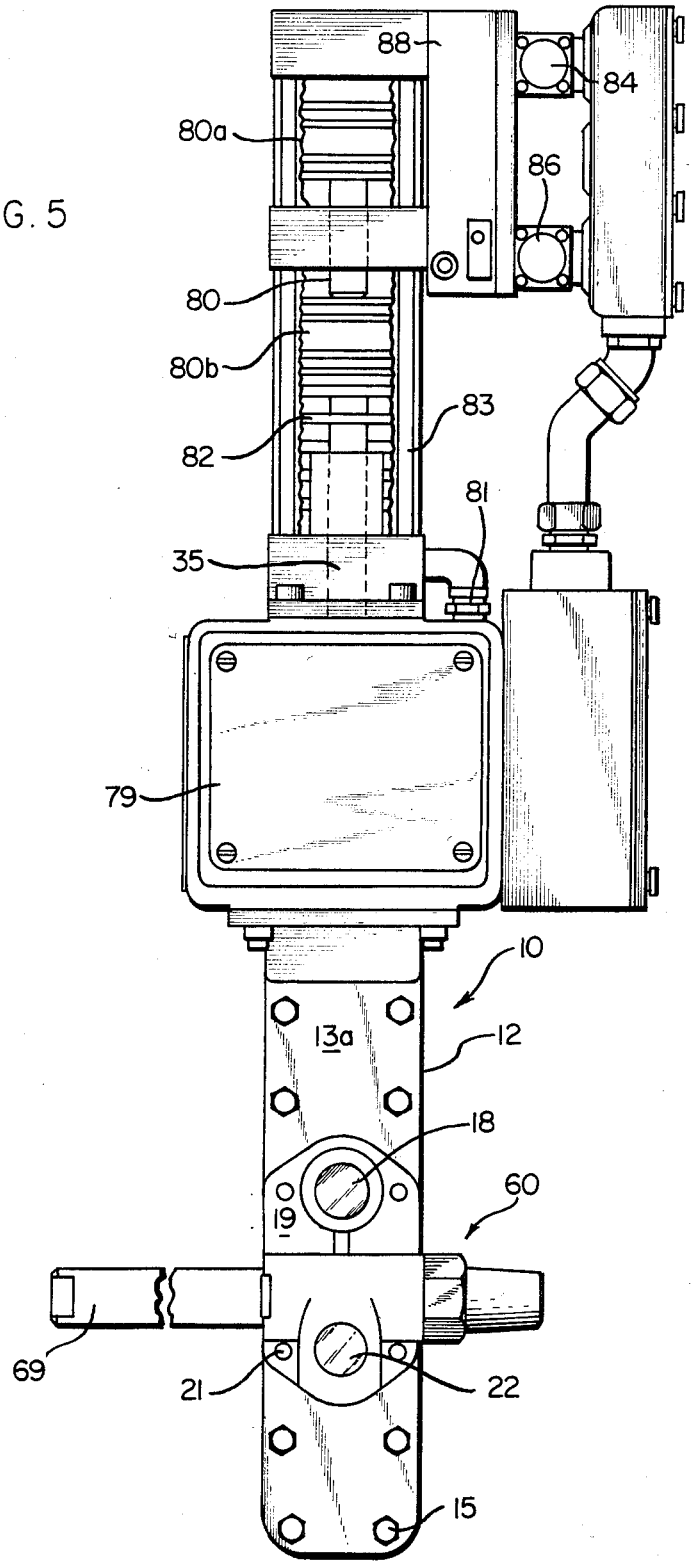
FIG. 5 is a partially fragmented side view of the improved control and purge valve of the present invention showing the air cylinder actuation system used to operate said valve.

Valve disc carrier means 16 includes a valve stem 35 which may preferably have a threaded proximal portion 36 for connection to the valve actuating means comprising fluidic cylinders, as shown in FIG. 5, for example. Valve stem 35 is attached by a clevis linkage 38 to the elongated disc carrier 16.

Elongated disc carrier 16 is successively slid within central bore 14 by means of such actuating means from the closed position of FIG. 1, to the purging position of FIG. 2, to the open position of FIG. 3.

Disc carrier 16 preferably carries a plurality of separate closure and orifice discs inserted thereon, although one-piece construction may be utilized in alternative embodiments. A first closure disc 42 is provided for closing oil entry port 32 when in the closed position of FIG. 1. A second closure disc 44 is provided for closing steam bypass entry port 30 when in the closed of FIG. 1, and for closing oil entry port 32 when in the purging position of FIG. 2. A first orifice disc 46 is provided for opening steam bypass entry port 30 when in the purging position of FIG. 2, and for opening oil entry port 32 when in the open position of FIG. 3. Disc carrier 16 also carries a third closure disc 48 for closing steam entry port 28 when in the closed position of FIG. 1 and for closing steam bypass entry port 30 when in the open position of FIG. 3. A fourth closure disc 50 is provided on disc carrier 16 for closing steam entry port 28 when in the purging position of FIG. 2 and may have a relatively smaller aperture 51 therein to permit a limited amount of steam therethrough. Finally, a second orifice disc 52 is provided for opening steam entry port 28 when in the open position of FIG. 3.

In preferred embodiments, each of steam entry port 28, steam bypass entry port 30, and oil entry port 32 contains a respective valve follower 28*a*, 30*a*, 32*a* with each having a valve follower aperture therein. The respective valve followers 28*a*, 30*a*, 32*a* are engaged by respective springs 28*b*, 30*b*, 32*b* to urge respectively valve followers 28*a*, 30*a*, 32*a* into snug and operative engagement with the various closure and orifice means on the disc carrier means 16.

Valve body 12 further includes a steam exit port 54, a steam bypass exit port 56 and an oil exit port 58, each of which is respectively disposed opposite steam entry port 28, steam bypass entry port 30, and oil entry port 32. As shown in FIGS. 1, 2, and 3, steam exit port 54 communicates with steam outlet means 20, and steam bypass exit port 56 and oil exit port 58 communicate with oil and steam purge outlet means 24.

Also in preferred embodiments, respective seat rings are 54*a*, 56*a*, 58*a* are disposed within each of steam exit port 54, steam bypass exit port 56, and oil exit port 58 for engagement with the closure and orifice means.

Each of respective valve followers 28*a*, 30*a*, 32*a*, the closure and orifice discs 42, 44, 46, 48, 50, 52, and seat rings 54*a*, 56*a*, 58*a* is preferably sealed with an O-ring to prevent leakage as shown in FIGS. 1, 2 and 3.

Figure 4:
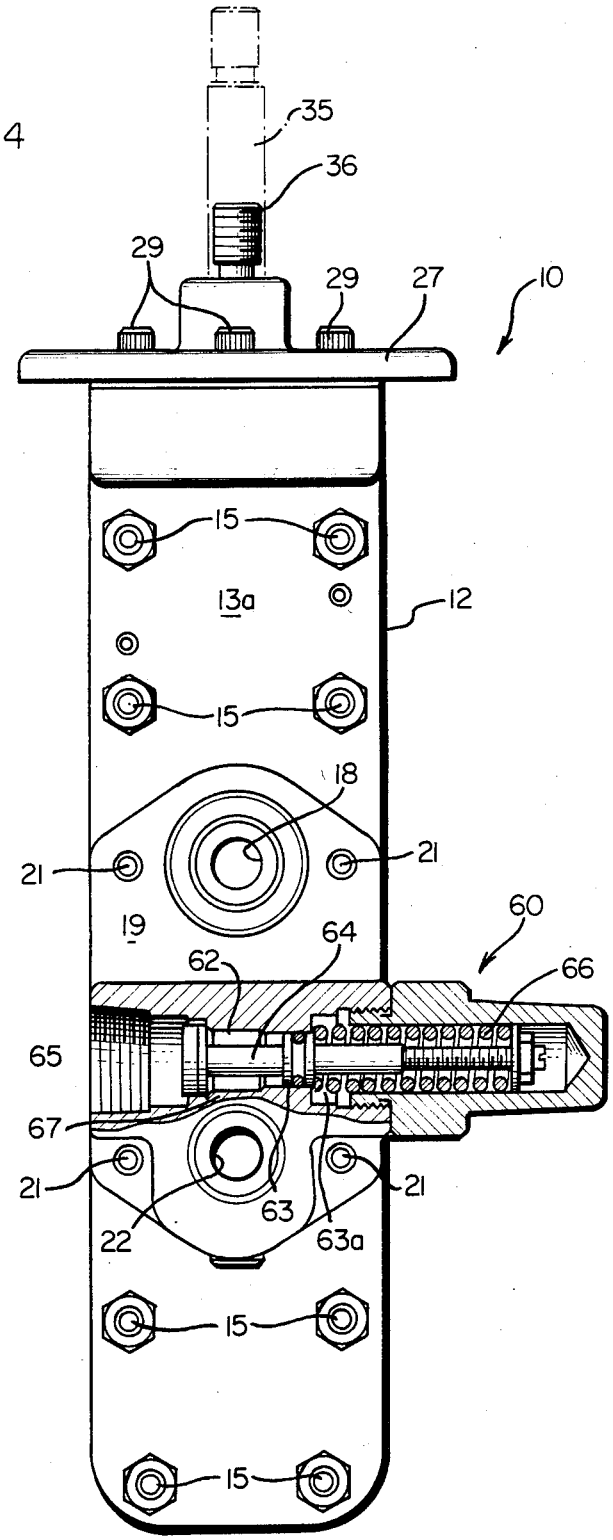
FIG. 4 is a partially fragmented side view of the improved control and purge valve of the present invention showing the valve body, with the proximal portion of the valve stem operatively exiting from the top thereof shown in the open position, and (in phantom lines) in the closed position, and further showing the externally opening steam inlet and oil inlet means, and disposed vertically therebetween in partial cross-section the spring loaded oil bypass means.

As shown particularly in FIG. 4, an oil bypass means generally 60 is provided for recirculating the oil to an oil supply when valve 10 is in either the closed position of FIG. 1 or the purging position of FIG. 2. Oil bypass means 60 communicates with oil inlet means 22, and comprises a chamber 62 having a relief plunger 64 disposed therein. Relief plunger 64 has a plunger head 65 engaging a plunger seat 67. Relief plunger 64 has a screw adjustable urging spring 66 engaged therewith and disposed to urge relief plunger 64 into closed disposition as shown in FIG. 4. The pressure of urging spring 66 is adjusted to be less than the oil pressure present when the oil entry port 32 is closed by the closure and orifice means. Although the area plunger head 65 is greater than the area of piston 64, this physical relationship alone does not cause the bypass means to open when the pressure in chamber 62 reaches a particular value. Of equal if not greater importance, is the fact that the portion of chamber 62 adjacent to plunger 65 has a greater diameter than the portion of chamber 62 in which postion 64 reciprocates. Thus, when valve 10 is in the closed or purging position of FIG. 1 or 2 respectively, the oil pressure within oil bypass means chamber 62 is sufficient to push relief plunger head 65 away from its seat 67, and thereby to recirculate the oil to the supply thereof.

The plunger head 65 of the bypass means 60 shown in the preferred embodiment of FIG. 4 has a greater area than that of the seal 63 disposed adjacent O-ring seal 63*a* on plunger 64. Hence, internal pressure within chamber 62 will open the valve, and oil will exit valve 10 through exit conduct 69.

Referring again to FIGS. 1, 2 and 3, selectively operable purge means 34 of valve 10 has a first purge chamber 68 disposed externally of valve body 12 and longitudinally therein connecting steam entry port 28 with steam bypass entry port 30. A second purge chamber 70 is also disposed externally of valve body 12 and longitudinally thereon and oppositely disposed within valve body 12 from first purge chamber 68. Second purge chamber 70 communicates bypass entry port 30 with oil and steam purge outlet means 24. The further details of the elements of selectively operable purge means 34 are more completely defined hereinbelow in regard to the description of FIG. 2.

In FIGS. 1, 2 and 3, the various arrows A show the flow of steam, and the various arrows C show the flow of oil.

In FIG. 1, which depicts the closed position of valve 10, arrow A1 shows steam entering steam inlet means 18 and arrow A2 shows the steam being blocked by third closure disc 48 from further entry, but arrow C3 shows oil entering the automatic oil bypass mechanism chamber 62.

In the open position of FIG. 3, arrow A1 shows steam entering steam inlet means 18; arrow A3 shows steam passing through steam entry port 28 through the orifice in orifice disc 52 and into the steam exit port 54; and arrow A4 shows steam leaving valve 10 through steam outlet means 20. Also in FIG. 3, arrow C1 shows oil entering oil inlet means 22; arrow C4 shows oil passing through oil entry port 32, through the orifice in orifice disc 46 and into oil exit port 58; and arrow C5 shows oil leaving valve 10 through oil and steam purge outlet means 24 for atomization by the steam illustrated by arrow A4, supra.

Selectively operable purge means 34 includes the following elements:

(a) purge chambers 68 and 70 which are disposed on opposite sides of central board 14;

(b) central board 14 containing valve disk carrier 16 which carries orifice disc 48 and closure disks 44, 48;

(c) orifice disc 46 allowing communication between the bypass entry port 30 and bypass exit port 56 when the valve is in the purge position of FIG. 2; and (d) closure disks 44 and 48 for preventing communication between the bypass entry port 30 and bypass exit port 56 when the valve is in the closed position of FIG. 1 or the open position of FIG. 3.

In the purging position of FIG. 2, arrow A1 shows steam entering steam inlet means 18; arrow A5 shows a first portion of the steam entering steam entry port 28 and passing through the reduced diameter orifice in closure disc 50; and arrow A6 shows this first portion of the steam passing through steam exit port 54 and leaving valve 10 through steam outlet means 20. Arrow A7 shows a second portion of the steam passing through purge means 34 including passage through first purge chamber 68, and into steam bypass entry port 30. Arrow A8 shows further passage of this second portion of the steam through the orifice in orifice disc 46, and into steam bypass exit port 56. Arrow A9 shows yet further passage of this second portion of the steam through second purge chamber 70 of purge means 34, and into oil and steam purge outlet means 24. Finally, arrow A10 shows passage of this second portion of the steam from valve 10 through oil and steam purge outlet means 24 for purging the oil line connected to the accompanying oil burner.

Advantages attendant the use of the improved control and purge valve 10 of the present invention include the ability to shut off the flow of steam and oil to the burner. Also, the flow of steam and oil to the burner may be sequenced so that only steam is passed through the accompanying steam tube to the burner and through the oil tube to the burner in the purge cycle, and steam through the steam tube and oil through the oil tube when in the open position of FIG. 3. Also, the flow of oil is automatically maintained through oil bypass means 60 which diverts the oil into a return line connected to the oil supply tank. Yet additionally, the improved control and purge valve of the present invention is adapted to represent a savings in space by the elimination of excess solenoid valves and excess plumbing connections adjacent the burner.

In operation, when the improved valve 10 of the present invention is in the closed position of FIG. 1, the cylinder spring holds the valve stem 35 in its uppermost position, preferably with approximately 80 pounds of spring pressure. The seat rings 54*a*, 56*a*, 58*a* and valve followers 28*a*, 30*a*, 32*a* have in preferred embodiments solid discs 42, 44, 48 sandwiched there between in the closed position of FIG. 1. Also, in the closed position of FIG. 1, the automatic oil return means 60 is open and returning the pressurized oil to its source.

From the closed position of FIG. 1, valve 10 can be moved to either the purging position of FIG. 2 or to the open, or firing, position of FIG. 3.

Moreover, when valve 10 is actuated to the purging position, which is the center position as shown in FIG. 2, the atomizing steam, or air in other preferred embodiments, enters through steam inlet 18, goes through steam entry port 28, steam bypass port 30, and exits valve 10 through oil and steam outlet means 20 by the utilization of closure disc 50 with a small orifice 51 therein to permit such limited flow.

In the purging position of FIG. 2, automatic bypass mechanism 60 is returning oil to the storage tank, just as it functions when valve 10 is in the closed position of FIG. 1.

To move valve 10 to the open, or firing position of FIG. 3, the second stage of the tandem cylinder is activated. At this time, valve disc carrier 16 is moved downwardly again. Orifice discs 46, 52 line up with both steam inlet 18 and steam outlet 20 and with oil inlet 22 and oil steam urge outlet 24, thus introducing atomizing steam and oil to the burner. When valve 10 is in the open or firing position of FIG. 3, the automatic oil return valve mechanism 60 closes and stops the flow of oil to the supply tank.

After the operation of valve 10 in the open position of FIG. 3, valve 10 is returned to the purging position of FIG. 2, which directs the steam back into the oil line for purging the same. Simultaneously therewith, automatic valve return mechanism 60 sends oil back to the supply tank. After the oil line has been purged, valve 10 of the present invention returns to the closed position of FIG. 1 and the flow of oil continues to the oil supply tank through the automatic bypass.

As shown in FIG. 5, the preferred actuator for use in the improved control and purge valve 10 of the present invention is a two-stage tandem air cylinder 80 having upper and lower halves 80*a*, 80*b*. The air cylinder 80 is mounted above name plate housing 79 and is activated by two electrically or pneumatically operated four-way solenoid valves 84, 86, one connected by manifold 88 to each stage 80*a*, 80*b* of the tandem air cylinder 80. A breather 81 is provided for air cylinder 80 on cylinder housing 83. Although as little as 40 pounds of air pressure will operate the actuator, 60 to 100 pounds of air pressure is preferred. Although air is used to move the valve from the closed, to purging, to open positions of FIGS. 1, 2, and 3 respectively, an internal return spring 82 is preferably used inside preferably the second-stage cylinder to reverse the action of the present invention. Thus, in the case of an electrical failure or air failure, the return spring 82 will close valve 10 and automatic bypass mechanism 60 will open, as long as there is enough oil pressure to open it.

In other alternative embodiments, valve 10 of the present invention may be closed by means other than a return spring. In such embodiments, a third four-way solenoid valve may be added to the bottom of the second-stage cylinder. In this embodiment, if an electrical or air failure occurs, the valve will remain in the position that it is in when the failure took place.

Figure 6:
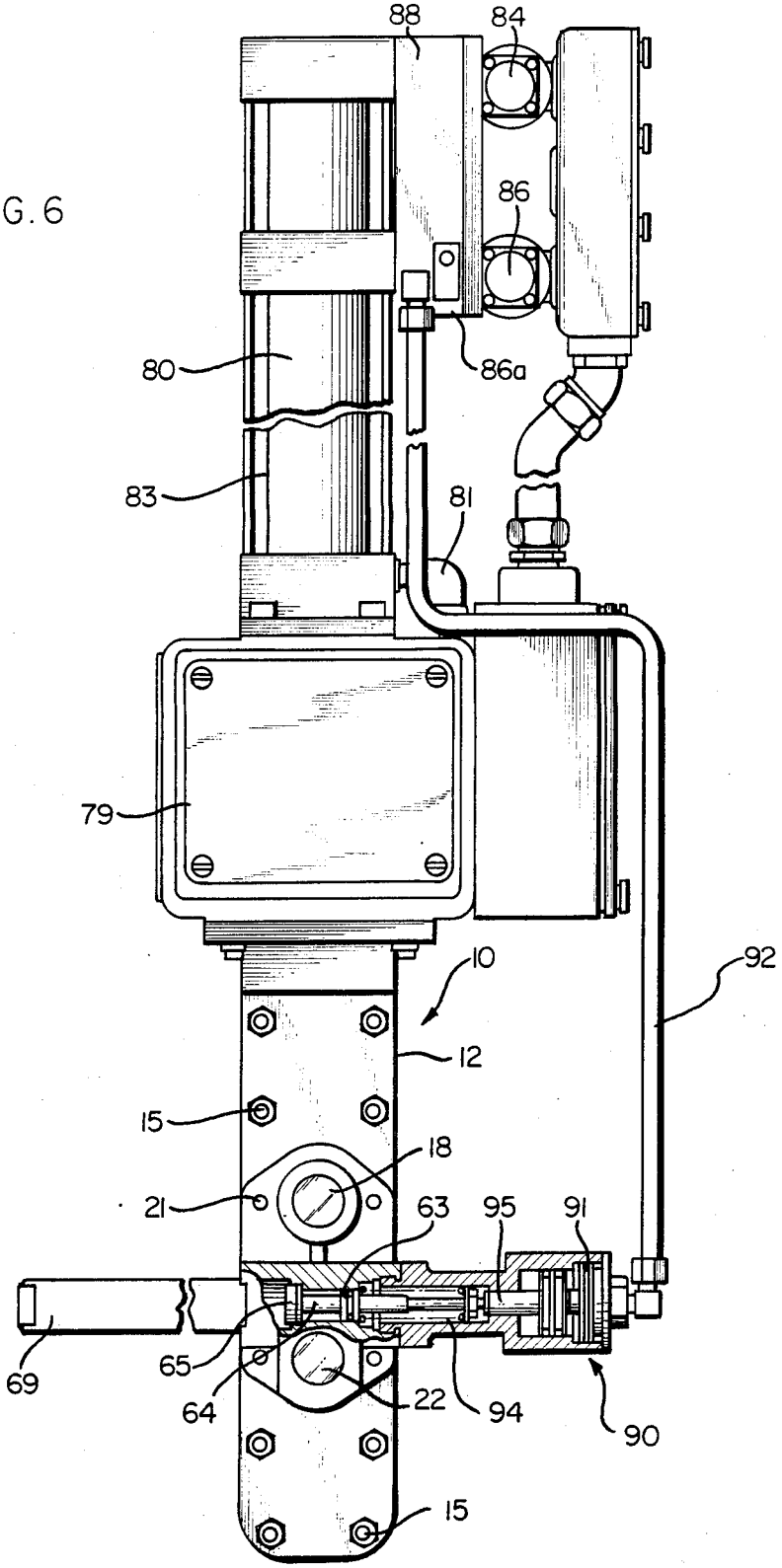
FIG. 6 is a partially fragmented side view of the improved control and purge valve of the present invention showing an alternative means of operating the bypass mechanism.

It is within the contemplation of the present invention that more than one valve of the present invention may be fed from a single oil source, as well as in other situations where a sufficient amount of oil pressure is not available to open automatic bypass mechanism 60. In these embodiments and particularly as shown in FIG. 6, automatic bypass valve mechanism 60 may be replaced by a cylinder assembly generally 90. Tubing 92 is then run from one side 86*a* of the four-way solenoid valve 86 to the bypass valve cylinder assembly 90. In this manner, when the second cylinder 80*b* is deactivated, the bypass valve cylinder 91 is activated, and vice versa. When activated, the piston 95 in bypass valve 91 cylinder pushes on plunger 64, and thus opens the flow of oil to the oil source, similarly to the embodiment of FIG. 4. When the bypass valve cylinder 91 is deactivated, the bypass valve return spring 94 pushes the valve stem closed.

Although the invention has been described in terms of preferred methods and structures, it will be readily apparent to those skilled in the art that many alterations and modifications thereto may be made without departing from the invention. Accordingly, it is intended that all such modifications and alternations be included within the scope of the invention as defined by the appended claims and equivalents thereof.

What is claimed is:

1. An improved control and purge valve for atomization of heavy fuel oil for combustion, said valve operable between closed, purging, and open positions and comprising:

an elongated valve body, said valve body having a longitudinally disposed central bore for containing valve disc carrier means and carrying steam inlet means, steam outlet means, oil inlet means, and oil and steam purge outlet means externally disposed thereon;

said valve body further having an internally disposed steam entry port, an internally disposed steam bypass entry port, and an internally disposed oil entry port, and also having disposed respecting oppositely from said entry ports an internally disposed steam exit port, an internally disposed bypass exit port, and an internally diposed oil exit port, said entry and exit ports disposed transversely of and opening into said central bore;

selectively operable purge means connecting said steam inlet means and said oil and steam purge outlet means through said steam bypass entry port for purging said oil and steam purge outlet means when the valve is in the purging position;

said valve disc carrier means disposed within said central bore of said valve body for operation between the closed, purging and open positions, and including respective closure and orifice means thereon for:

(a) closing each of said steam entry, steam bypass entry, and oil entry ports when in the closed position;

(b) opening at least said steam bypass port and closing said oil entry port when in the purging position, and (c) opening said steam entry and oil entry ports and closing said steam bypass entry port when in the open position; steam entry port, steam bypass entry port, and oil entry port valve followers disposed within said valve body for snug and operative engagement with said respective closure and orifice means of said valve disc carrier mean, having openings therein disposed for transverse communication into said central bore; and valve actuating means for providing selected longitudinal movement of said valve disc carrier within said valve central bore to effect thereby the closed, purging, and open positions thereof.

2. The improved control and purge valve of claim 1 wherein the closed, purging, and open positions of the valve are effected by successive sliding extention of said valve disc carrier within said valve central bore.

3. The improved control and purge valve of claim 1 wherein said valve disc carrier means carries a plurality of closure and orifice discs thereon.

4. The improved control and purge valve of claim 3 wherein said closure and orifice discs comprise in sequential array from the distal to the proximal end of said disc carrier:

(a) a first closure disc for closing said oil entry port when in the closed position;

(b) a second closure disc for closing said steam bypass entry port when in the closed position and for closing said oil entry port when in the purging position;

(c) a first orifice disc for opening said steam bypass entry port when in the purging position and for opening said oil entry port when in the open position;

(d) a third closure disc for closing said steam entry port when in the closed position and for closing said steam bypass entry port when in the open position;

(e) a fourth closure disc for closing said steam entry port when in the purging position; and (f) a second orifice disc for opening said steam entry port when in the open position.

5. The improved control and purge valve of claim 4 wherein said fourth closure disc has an orifice therein which is substantially smaller in diameter than the orifice of said first orifice disc, whereby a limited amount of steam is permitted to exit the valve from the steam outlet means when in the purging position.

6. The improved control and purge valve of claim 1 wherein said valve followers are engaged by respective springs to urge said valve followers into snug and operative engagement with said closure and orifice means on said valve disc carrier.

7. The improved control and purge valve of claim 1 wherein said steam exit port communicates with said steam outlet means, and said steam bypass exit port and said oil exit port communicate with said oil and steam purge outlet means.

8. The improved control and purge valve of claim 7 wherein said steam exit port communicates directly with said steam outlet means.

9. The improved control and purge valve of claim 7 wherein said oil exit port communicates directly with said oil outlet means.

10. The improved control and purge valve of claim 1 further comprising seat rings disposed within each of said steam exit port, steam bypass exit port, and said oil exit port for engagement with said closure and orifice means of said valve disc carrier.

11. The improved control and purge valve of claim 1 wherein each of said valve followers is sealed with an O-ring to prevent leakage.

12. The improved control and purge valve of claim 3 wherein each of said closure and orifice discs is sealed with an O-ring to prevent leakage.

13. The improved control and purge valve of claim 10 wherein each of said seat rings is sealed with an O-ring to prevent leakage.

14. The improved control and purge valve of claim 1 further comprising oil bypass means for recirculating oil to an oil supply when in either of the closed or purging positions.

15. The improved control and purge valve of claim 14 wherein said oil bypass means communicates with said oil inlet means.

16. The improved control and purge valve of claim 15 wherein said oil bypass means comprises a chamber having disposed therein a relief plunger including a plunger head thereon, said plunger head seated in said chamber, said relief plunger having a spring engaging therewith disposed to urge said relief plunger head into seated disposition with a pressure which is less than the oil pressure when the oil entry port is closed by said closure and orifice means, whereby when the valve is in the closed or purging positions the oil pressure within the oil bypass means chamber is sufficient to push said relief plunger head away from its seated position and thereby to recirculate the oil to the supply thereof.

17. The improved control and purge valve of claim 1 wherein valve actuating means comprises a two stage tandem fluidic cylinder, each stage of which extends in response to a four-way solenoid valve to move the valve of the present invention from the closed, to the purging, and to the open position.

18. The improved control and purge valve of claim 17 further comprising a return spring disposed inside said tandem cylinder for retracting the valve of the present invention from the open, to the purging, and to the closed position, whereby the valve of the present invention is urged into closed position in the event of a failure of pressure to said fluidic cylinder.

19. The improved control and purge valve of claim 1 wherein said purge means includes a first purge chamber disposed externally of said valve body and longitudinally therein respectively connecting said steam entry port with said steam bypass entry port, and a second purge chamber disposed externally of said valve body, longitudinally therein, and oppositely disposed from said first purge chamber communicating said bypass entry port with said oil and steam purge outlet means.

20. The improved control and purge valve of claim 1 wherein said steam entry port and oil entry ports are disposed perpendicularly of said central bore.

21. The improved control and purge valve of claim 1 wherein said steam exit port and said oil exit port are disposed perpendicularly of said central bore.

22. The improved control and purge valve of claim 1 wherein said valve body includes external side walls and said steam inlet means and said oil inlet means are unitarily formed and secured to one said side wall of said valve body.

23. The improved control and purge valve of claim 22 wherein said steam outlet means and said oil and steam purge outlet means are unitarily formed and secured to another opposite side wall of said valve body.

* * * * *